US005894883A

United States Patent [19]

Gentry et al.

[11] Patent Number: 5,894,883

[45] Date of Patent: Apr. 20, 1999

[54] SHELL AND TUBE HEAT EXCHANGER

[75] Inventors: Matthew C. Gentry; Cecil C. Gentry, both of Bartlesville, Okla.

[73] Assignee: Phillips Petroleum Company, Bartlesville, Okla.

[21] Appl. No.: 09/048,506

[22] Filed: Mar. 25, 1998

[51] Int. Cl.[6] ..... F28D 7/00

[52] U.S. Cl. ..... 165/81; 165/159; 165/162; 165/DIG. 402; 165/DIG. 417

[58] Field of Search ..... 165/81, 82, 159–162, 165/DIG. 402, DIG. 417, DIG. 419

[56] References Cited

U.S. PATENT DOCUMENTS

| | | | |
|---|---|---|---|
| 1,831,454 | 11/1931 | Kirgan | 165/83 |
| 2,256,882 | 9/1941 | Sebald | 165/72 |
| 2,505,695 | 4/1950 | Villiger et al. | 165/DIG. 419 |
| 2,607,567 | 8/1952 | Hobbs | 165/DIG. 402 |
| 4,265,301 | 5/1981 | Anderson | 165/162 |
| 4,305,458 | 12/1981 | Jogand | 165/162 |
| 4,433,722 | 2/1984 | Fueglister | 165/162 |
| 4,506,728 | 3/1985 | Gentry | 165/96 |
| 4,635,707 | 1/1987 | Gentry | 165/1 |
| 4,724,900 | 2/1988 | Baurmeister et al. | 165/76 |
| 5,203,405 | 4/1993 | Gentry et al. | 165/160 |

*Primary Examiner*—Allen Flanigan
*Attorney, Agent, or Firm*—Richmond, Hitchcock, Fish & Dollar

[57] ABSTRACT

There is provided a combination for use in a shell and tube heat exchanger which comprises: a shell having a substantially horizontally extending longitudinal axis and an open end; an annular distributor adjacent to the shell end and having an annular chamber defined therein in fluid communication with the shell interior through the shell end; a tubesheet longitudinally spaced from the shell end; a baffle cage having an interior portion in the shell interior and an exterior portion outside the shell between the tubesheet and shell end, wherein the baffle cage is longitudinally spaced from and unconnected to the tubesheet; a bundle of tubes extending from the tubesheet and through the baffle cage and shell interior; and a support member having a lower end fixedly connected to the interior surface of the annular distributor and an upper end contacting but not connected to the exterior portion of the baffle cage at a lowermost location thereof.

10 Claims, 2 Drawing Sheets

SHELL AND TUBE HEAT EXCHANGER

BACKGROUND OF THE INVENTION

This invention relates to shell and tube heat exchangers.

All shell and tube heat exchangers include a shell and a bundle of tubes extending between opposing tubesheets. Heat is exchanged between a shellside fluid flowing through the shell and tubeside fluid flowing through the tubes.

A very desirable feature frequently employed in shell and tube heat exchangers is the annular distributor. Annular distributors can reduce shellside inlet and outlet pressure losses, reduce impingement velocities, and improve shellside fluid distribution. An annular chamber defined in the annular distributor is most conventionally in fluid communication with the shell interior through circumferentially spaced apertures in the shell wall.

Another feature common in shell and tube heat exchangers is a baffle cage. A baffle cage, as positioned in the shell, assists in support of the tubes within the shell and minimizes vibration and movement of the tubes. The baffle cage typically comprises longitudinally spaced baffles and longitudinally extending tie bars that interconnect the baffles. Preferably, the tie bars are connected at one end to one tubesheet, but are spaced from and left unconnected to the other tubesheet to allow for thermal expansion and contraction. If the tie bars were connected to both tubesheets, thermal expansion or contraction of the tie bars could cause longitudinal pressure upon the tubesheets and consequent loosening of the connection between the tubes and tubesheets. This effect exists even if one of the tubesheets is a "floating" tubesheet, since the tubes and tie bars expand and contract differently because of different temperatures and typically different materials.

SUMMARY OF THE INVENTION

According to the invention, there is provided a combination for use in a shell and tube heat exchanger which comprises: a shell having a substantially horizontally extending longitudinal axis, an open end, and an interior; an annular distributor adjacent to the shell end and having an interior surface and an annular chamber defined therein in fluid communication with the shell interior through the shell end; a tubesheet longitudinally spaced from the shell end; a baffle cage having an interior portion in the shell interior and an exterior portion outside the shell between the tubesheet and shell end, wherein the baffle cage is longitudinally spaced from and unconnected to the tubesheet; a bundle of tubes extending from the tubesheet and through the baffle cage and shell interior; a support member having a lower end fixedly connected to the interior surface of the annular distributor and an upper end contacting but not connected to the exterior portion of the baffle cage at a lowermost location thereof. Preferably, the baffle cage comprises longitudinally spaced baffles and longitudinally extending tie bars interconnecting the baffles and having ends longitudinally spaced from and unconnected to the tubesheet.

The open shell end as longitudinally spaced from the tubesheet allows shellside fluid to flow from the annular chamber into and through the shell end as a shell inlet, or from the shell end as a shell outlet to the annular chamber. However, this leaves an end portion of the tube bundle unsupported by the shell. The baffle cage provides inadequate support because it (i.e. ends of the tie bars) is longitudinally spaced from and unconnected to the tubesheet. The support member provides the needed support for the end portion of the tube bundle. The support member is in contact with but not connected to the baffle cage to allow for thermal expansion and contraction of the baffle cage and consequent longitudinal movement relative to the support member.

DETAILED DESCRIPTION OF THE INVENTION

Figure 1:
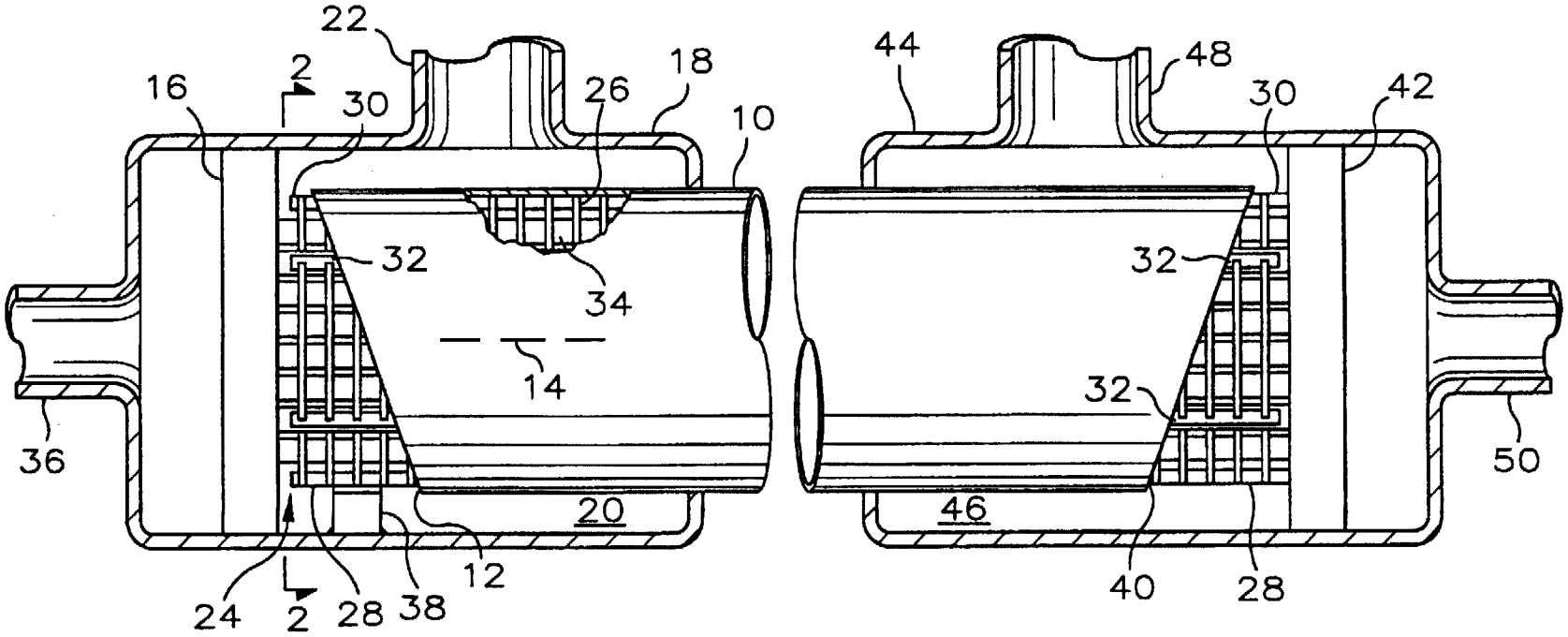
FIG. 1 shows a shell and tube heat exchanger in accordance with one embodiment of the invention. The exchanger includes a pair of annular distributors shown in cross section to reveal a side view of a pair of tubesheets, a tube bundle, a baffle cage, and a shell. A middle portion of the shell, tube bundle, and baffle cage is broken away.

Referring to FIG. 1, shell 10 has an open end 12 and a substantially horizontally extending longitudinal axis 14. Shell end 12 is longitudinally spaced from a tubesheet 16. In the illustrated embodiment, shell end 12 is beveled so that its uppermost point is closest to tubesheet 16 and its lowermost point is farthest from tubesheet 16. The bevel is desirable as providing a more even distribution of shellside fluid through shell end 12. An annular distributor 18, adjacent to shell end 12, has an annular chamber 20 defined therein which is in fluid communication with the shell interior through shell end 12. Annular distributor 18 has a shellside nozzle 22 at an uppermost location thereon which is in fluid communication with annular chamber 20.

A baffle cage 24 is shown as having an exterior portion outside shell 10 between tubesheet 16 and shell end 12 and an interior portion in the shell interior, as revealed by a portion of shell 10 which is broken away. Baffle cage 24 comprises a plurality of longitudinally spaced baffles 26 and a plurality of longitudinally extending tie bars interconnecting the baffles. The tie bars include a lower tie bar 28 at the lowermost location of baffle cage 24, an upper tie bar 30 at the uppermost location of baffle cage 24, and intermediate tie bars 32. There are four intermediate tie bars in the illustrated embodiment (only two of which are visible in FIG. 1), but additonal intermediate tie bars could be used if desired. The tie bars are typically connected to the baffles by means of inner slots in the tie bars and outer slots in the baffles which mate. Of course, such slots are not visible when the tie bars and baffles are connected as in FIG. 1. As shown, tie bars 28, 30, and 32 have ends (the left ends in FIG. 1) longitudinally spaced from and unconnected to tubesheet 16 for reasons discussed previously.

A bundle of tubes, such as shown at 34, extend from tubesheet 16 and through baffle cage 24 and the interior of shell 10. Eight tubes are visible in the embodiment of FIG. 1. Of course, any number of tubes could be employed. For ease of illustration, the tubes shown in FIG. 1 are larger than those typically used in actual practice. A tubeside nozzle 36 is in fluid communication with the tubes through tubesheet 16.

A support member 38 has a lower end fixedly connected to the interior surface of annular distributor 18 and an upper end contacting but not connected to a portion of lower tie bar 28 extending from and exterior to shell 10 between shell end 12 and tubesheet 16. Support member 38 preferably longitudinally extends through annular distributor 18 so that its upper end contacts lower tie bar 28 along the length of such upper end. Most preferably, for optimum support of the tube bundle, support member 38 has a length which is at least about one-third the longitudinal distance between tubesheet 16 and the lowermost point of shell end 12.

Shell 10 has an open end 40 opposite shell end 12 and longitudinally spaced from a tubesheet 42. In the illustrated embodiment, shell end 40 is beveled in a manner similar to that of shell end 12. Annular distributor 44, adjacent to shell end 40, has an annular chamber 46 defined therein in fluid communication with the interior of shell 10 through shell end 40. Annular distributor 44 has a shellside nozzle 48 at an uppermost location thereon which is in fluid communication with annular chamber 46.

Tie bars 28, 30, and 32 have ends (the right ends in FIG. 1) which are fixedly connected to tubesheet 42. The tubes, previously described as extending from tubesheet 16 and through baffle cage 24 and the interior of shell 10, extend from shell end 40 to tubesheet 42. A tubeside nozzle 50 is in fluid communication with the tubes through tubesheet 42.

In operation, shellside fluid can flow through shell 10 in either direction. Tubeside fluid typically flows through the tubes in a direction opposite to the flow direction of the shellside fluid.

Figure 2:
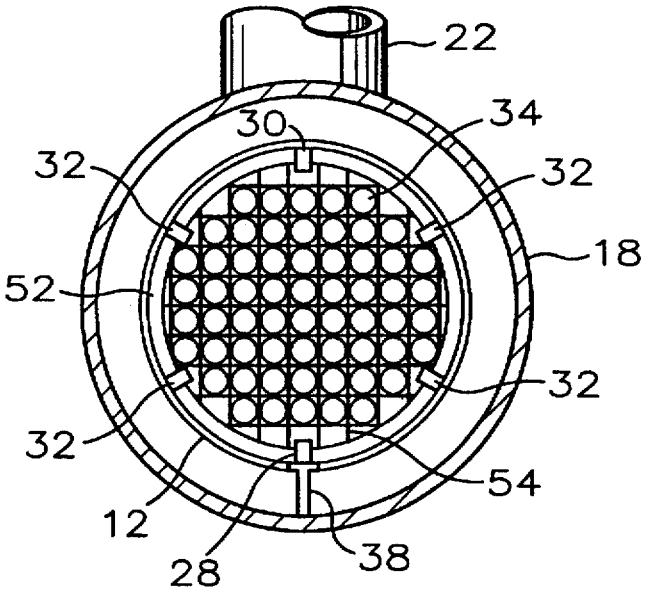
FIG. 2 is a cross-sectional view as viewed along line 2—2 in FIG. 1.

Referring now to FIG. 2, each baffle preferably comprises a baffle ring 52 and chordally extending support rods, such as shown at 54. Only a single baffle ring of one baffle is visible in FIG. 2. The crisscross pattern of support rods as shown is the pattern as it appears from the superposition of the support rods for a four-baffle set, as is well known in the art. Tubes, such as shown at 34, fit within the spaces defined between the support rods. RODbaffle, a trademark of Phillips Petroleum Company of Bartlesville, Okla., designates the type of baffle design of FIG. 2 in a shell and tube heat exchanger.

Lower tie bar 28 and upper tie bar 30, as fixedly connected to tubesheet 42, are preferably larger in size than is typical in order to provide additional and adequate support of the end portion of the tube bundle unsupported by shell 10 adjacent to shell end 40 (FIG. 1). A support member such as support member 38 is, therefore, not necessary to support this end portion of the tube bundle. By way of example, lower tie bar 28 and upper tie bar 30 could have a width (as measured radially with respect to the shell) of 2 inches and a thickness (as measured perpendicular to the width) of 1 inch, whereas each intermediate tie bar could have a standard width of 1.5 inches and a thickness of 1 inch. Thus, each of the lower and upper tie bars have a larger cross-sectional area than the intermediate tie bars.

Preferably, as shown, support member 38 is substantially "T" shaped.

Figure 3:
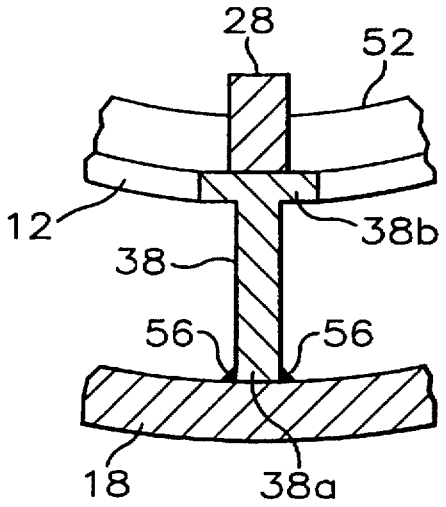
FIG. 3 is an enlarged, cross-sectional view of a portion of the exchanger.

Referring now to FIG. 3, there is shown a cross-sectional view of lower tie bar 28 and support member 38. Lower end **38*a* of support member 38 is shown as being fixedly connected to the interior surface of annular distributor 18 by welds 56. Upper end 38*b* of support member 38 is shown as being in contact with but not connected to lower tie bar 28 in order to allow for thermal expansion and contraction of lower tie bar 28. Upper end 38*b* has a width of preferably about 2–4 times the thickness of lower tie bar 28 to allow for some margin of error when, during assembly of the exchanger, lower tie bar 28 slides onto and over the upper surface of upper end 38*b*. The width of upper end 38*b* is measured in the same direction as the thickness of lower tie bar 28**.

The material employed for support member 38 can be, for example, any metal compatible with the shellside fluid. Support member 38 can be most conveniently fabricated by cutting off one end of an I-beam to the desired dimensions.

Obviously, many modifications and variations of the present invention are possible in light of the above teachings. For example, the support member need not necessarily be "T" shaped, and ends of the shell can be straight (i.e. perpendicular to the shell longitudinal axis) rather than beveled as illustrated. It is, therefore, to be understood that within the scope of the appended claims, the invention may be practiced otherwise than as specifically described.

That which is claimed is:

1. In a shell and tube heat exchanger, a combination comprising:

a shell having a substantially horizontally extending longitudinal axis, an open end, and an interior;

an annular distributor adjacent to the shell end and having an interior surface and an annular chamber defined therein in fluid communication with the shell interior through the shell end;

a tubesheet longitudinally spaced from the shell end;

a baffle cage having an interior portion in the shell interior and an exterior portion outside the shell between the tubesheet and shell end, wherein the baffle cage is longitudinally spaced from and unconnected to the tubesheet;

a bundle of tubes extending from the tubesheet and through the baffle cage and shell interior;

a support member having a lower end fixedly connected to the interior surface of the annular distributor and an upper end contacting but not connected to the exterior portion of the baffle cage at a lowermost location thereof.

2. A combination as recited in claim 1 wherein the baffle cage comprises a plurality of longitudinally spaced baffles and a plurality of longitudinally extending tie bars interconnecting the baffles, and wherein the tie bars have ends longitudinally spaced from and unconnected to the tubesheet.

3. A combination as recited in claim 2 wherein each baffle comprises a baffle ring and a plurality of chordally extending support rods fixedly connected to the baffle ring.

4. A combination as recited in claim 2 wherein one of the tie bars, denoted as the lower tie bar, is at the lowermost location of the baffle cage and contacts the support member upper end.

5. A combination as recited in claim 4 wherein the support member longitudinally extends through the annular distributor so that the support member upper end contacts the lower tie bar along the length of the support member upper end.

6. A combination as recited in claim 5 wherein the support member is substantially "T" shaped.

7. A combination as recited in claim 6 wherein the support member upper end has a width of about 2–4 times the thickness of the lower tie bar.

8. A combination as recited in claim 7 wherein the support member has a length which is at least about one-third the longitudinal distance between the tubesheet and the lowermost point of the shell end.

9. A combination as recited in claim 8 wherein the aforementioned shell end, annular distributor, annular chamber, tubesheet, and tie bar ends are denoted respectively as the first shell end, first annular distributor, first annular chamber, first tubesheet, and first tie bar ends, and wherein the shell also has an opposing and open second shell end and the tie bars also have opposing second tie bar ends, and further wherein the combination further comprises: a second annular distributor adjacent to the second shell end and having a second annular chamber in fluid communication with the shell interior through the second shell end; and a second tubesheet longitudinally spaced from the second shell end and having fixedly connected thereto the second tie bar ends.

10. A combination as recited in claim 9 wherein one of the tie bars, denoted as the upper tie bar, is at the uppermost location of the baffle cage, and wherein in addition to the upper and lower tie bars there are at least two other intermediate tie bars, and further wherein each of the upper and lower tie bars have a larger cross-sectional area than the intermediate tie bars.

* * * * *